US008967114B2

(12) United States Patent
Gaither

(10) Patent No.: US 8,967,114 B2
(45) Date of Patent: Mar. 3, 2015

(54) ROTARY ENGINE WITH ROTARY POWER HEADS

(76) Inventor: John Larry Gaither, Camden, NC (US)

( * ) Notice: Subject to any disclaimer, the term of this patent is extended or adjusted under 35 U.S.C. 154(b) by 267 days.

(21) Appl. No.: 13/417,197

(22) Filed: Mar. 9, 2012

(65) Prior Publication Data

US 2012/0227703 A1 Sep. 13, 2012

Related U.S. Application Data

(60) Provisional application No. 61/450,654, filed on Mar. 9, 2011.

(51) Int. Cl.

| | |
|---|---|
| ***F02B 53/00*** | (2006.01) |
| ***F02B 53/04*** | (2006.01) |
| ***F01C 1/08*** | (2006.01) |
| ***F01C 1/24*** | (2006.01) |
| ***F01C 1/28*** | (2006.01) |
| ***F01C 21/08*** | (2006.01) |
| ***F01C 21/18*** | (2006.01) |

(52) U.S. Cl.

CPC . *F01C 1/28* (2013.01); *F01C 21/08* (2013.01); *F01C 21/18* (2013.01)

USPC ..... 123/232; 123/228; 123/246; 123/249; 418/191

(58) Field of Classification Search

USPC ..... 60/39.44; 123/232, 228, 246, 249; 418/191

See application file for complete search history.

(56) References Cited

U.S. PATENT DOCUMENTS

| | | | | |
|---|---|---|---|---|
| 819,089 | A * | 5/1906 | Shoemaker et al. | 60/39.44 |
| 1,970,594 | A * | 8/1934 | Brady | 123/232 |
| 2,297,529 | A * | 9/1942 | Berry | 418/191 |
| 3,260,248 | A * | 7/1966 | Lyle | 123/232 |
| 3,366,096 | A * | 1/1968 | Mathews | 60/39.44 |
| 3,886,908 | A * | 6/1975 | Ruzic | 123/213 |
| 4,144,004 | A | 3/1979 | Edwards | |
| 4,202,315 | A * | 5/1980 | Lutrat | 123/249 |
| 4,481,920 | A * | 11/1984 | Carr et al. | 123/246 |
| 5,362,219 | A | 11/1994 | Paul | |
| 6,062,188 | A * | 5/2000 | Okamura | 123/228 |
| 6,142,758 | A | 11/2000 | Taggett | |
| 6,539,913 | B1 * | 4/2003 | Gardiner | 123/228 |
| 2002/0157636 | A1 | 10/2002 | Klassen | |
| 2006/0120895 | A1 | 6/2006 | Gardner | |
| 2010/0132659 | A1 | 6/2010 | Ambardekar | |
| 2010/0251991 | A1 | 10/2010 | Drachko | |
| 2011/0107999 | A1 | 5/2011 | Murata | |

FOREIGN PATENT DOCUMENTS

| | | | | |
|---|---|---|---|---|
| DE | 102007054196 | A1 * | 5/2009 | F02G 1/043 |
| FR | 2574494 | A1 * | 6/1986 | F04C 18/06 |
| JP | 03286170 | A * | 12/1991 | F01C 1/22 |
| WO | WO 2011086183 | A2 * | 7/2011 | F01C 1/36 |

* cited by examiner

*Primary Examiner* — Thai Ba Trieu

(74) *Attorney, Agent, or Firm* — Kilpatrick Townsend & Stockton, LLP

(57) ABSTRACT

A rotary engine includes a casing having a large circular boring, a small circular boring, whereby the small circular boring interconnects with the large circular boring. A piston rotor is carried in a rotating manner within the large circular boring in the casing. A power head, ported to pass exhaust gases thru it's hollow center shaft, is carried in a rotating manner within the small circular boring in the casing. The piston rotor and the power head are meshed together to properly rotate during operation, with the piston rotor rotating counterclockwise and the power head rotating clockwise. A second powerhead can also be used.

14 Claims, 8 Drawing Sheets

ROTARY ENGINE WITH ROTARY POWER HEADS

CROSS-REFERENCE TO RELATED APPLICATION

This application claims the benefit of Provisional Patent Application No. 61/450,654, filed on Mar. 9, 2011, in the United States Patent & Trademark Office, the disclosure of which is incorporated herein by reference.

BACKGROUND OF THE INVENTION

1. Field of the Invention

The present invention relates to a rotating internal combustion engine, and more particularly, a rotary engine.

The ROTARY ENGINE WITH ROTARY POWER HEADS is a device designed to convert the heat energy stored in a fuel into mechanical energy through a process of combustion. The present invention provides an inexpensive, high torque, prime mover for everything from weed eaters to high performance aircraft. The process is one of pure rotation, it has no reciprocating parts, and is of a simple construction. This engine can be used to great advantage in any application that can be or is powered by conventional reciprocating engines and many turbines. The ROTARY ENGINE inherently supercharges and has perfect scavenging of exhaust gases. The ROTARY ENGINE combines the high-speed capabilities of turbines with the positive displacement character of reciprocating engines.

2. Description of the Prior Art

Other types of engines with similar capabilities have to be constructed from stronger, more expensive materials. These engines contain many more moving parts, which have to be machined with much greater difficulty and associated tooling expense. The weight and bulk of the other engines can make them unacceptable or undesirable for some applications. A more efficient alternative is needed.

Numerous innovations for rotary displacement engines have been provided in the prior art that will be described. Even though these innovations may be suitable for the specific individual purposes to which they address, however, they differ from the present invention.

A FIRST EXAMPLE, U.S. Pat. No. 4,144,004, issued on Mar. 13, 1979, to Edwards teaches a positive displacement engine utilizing interlocking vaned rotors and providing for the virtually complete exclusion of spent vapors following the expansion cycle.

A SECOND EXAMPLE, U.S. Pat. No. 5,362,219, issued on Nov. 8, 1994, to Paul et al. teaches a rotary air compressor with a housing forming an epitrochoidal chamber in which a multilobed rotor with a ring gear eccentrically rotates on an internal central gear in the housing, the rotor dividing the chamber into multiple sub-chambers of changing volume as the rotor rotates, the chamber having intake ports of variable size opening to change the quantity of gas that is compressible and outlet ports having spring biased plunger valves to prevent flow of discharged compressed air back into the compressor.

A THIRD EXAMPLE, U.S. Pat. No. 6,142,758, issued on Nov. 7, 2000, to Taggett teaches a rotary positive displacement engine that includes one or more power rotors, which are acted upon by a pressurized charge of gas, such as steam, and an annular barrier rotor geared for synchronous rotation with the power rotors. The rotors rotate within intersecting cylindrical bores in the engine housing. The power rotors have cylindrical outer surfaces from which opposed vanes extend which are acted upon by the powering charge. The barrier rotor has an outer cylindrical surface, located in close proximity to the cylindrical surface of the power rotors, and ports for delivering the powering charge to the power rotors. The barrier rotor thus forms both a charge delivery mechanism and a barrier between the exhaust ports and the expanding gas powering the engine. Located within the barrier rotor is a stator which has ports in fluid communication with the ports in the barrier rotor when the respective ports are aligned. The location of the barrier rotor is adjustable with respect to the power rotors to permit the clearances between the confronting surfaces of the barrier rotor and the power rotors to be adjusted to extremely tight tolerances under operating conditions, which provides high efficiency operation with very low amounts of contamination of the exhaust gas.

A FOURTH EXAMPLE, U.S. Patent Office Publication No. 2002/0157636, published on Oct. 31, 2002, to Klassen teaches a two-dimensional rotary displacement device which comprises a housing, an outer rotor and at least one inner rotor. The axes of rotation of the outer rotor and the at least one inner rotor are parallel. A predefined geometrical relationship exists between the outer and inner rotors such that the scale of operative circumference (or diameter) from the inner rotor with respect to the outer rotor is preferably an integer value. In one embodiment, the device is used as a compressor that positively displaces a gas. In a modified embodiment, the device includes an exit port, which has a location that can be adjusted with respect to the housing and is adjustable so as to decrease the pressure differential between an exit chamber and the exit pressure. In another embodiment, the device can be used as an external combustion engine wherein compressed gas is discharged from an exit chamber to a combustion chamber where the volume of gas is increased due to heating of the gas and a portion of the discharge gas is directed to the rotor assembly and the remaining volume of gas can be used for a "hot blow" thrust or other use or directed to an additional rotor assembly to induce a torque to an output shaft attached to the outer rotor of one or both of the rotor assemblies. In another embodiment, a portion of the compressed gas can be used for "cold blow" thrust or other purpose instead of directing all of the compressed gas through the combustor.

A FIFTH EXAMPLE, U.S. Patent Office Publication No. 2006/0120895, published on Jun. 8, 2006, to Gardner teaches a rotary positive displacement engine includes a compressor housing having a compression chamber therein and a rotor housing having a rotor chamber therein. The rotor housing and compressor housing are in fluid communication and define a main housing having a first end plate, an opposing second end plate, and a center divider plate interposed therebetween, wherein the first and second end, and center divider plates are connected to the main housing. An output member is rotatably supported within the main housing and extends axially therefrom. A compressor is disposed within the compressor chamber and is mounted on the output member. An engine rotor is disposed within the rotor chamber and is mounted on the output member. An engine rotor working end portion defines a combustion chamber, wherein fuel is ignited to rotate the engine rotor, which, in turn, rotates the output shaft.

It is apparent now that numerous innovations for rotary displacement engines have been provided in the prior art that are adequate for various purposes. Furthermore, even though these innovations may be suitable for the specific individual purposes to which they address, they would be inferior to the rotary engine for the purposes of the present invention as heretofore described.

SUMMARY OF THE INVENTION

AN OBJECT of the rotary engine is to provide a rotary engine that avoids the disadvantages of the prior art.

ANOTHER OBJECT of the rotary is to provide a high torque rotary engine that is simple and inexpensive to manufacture.

STILL ANOTHER OBJECT of the rotary engine is to provide a rotary engine that is simple to use and maintain.

BRIEFLY STATED, yet another object of the present invention is to provide a rotary engine which comprises a casing having a large circular boring and a small circular boring whereby the small circular boring interconnects with the large circular boring. A piston rotor rotates within the large circular boring in the casing. A power head rotates within the small circular boring in the casing. Proper rotational relationship between the piston rotor and the power head is maintained by a simple gear train external to this casing. The piston rotor rotates counterclockwise and the power head rotates clockwise.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
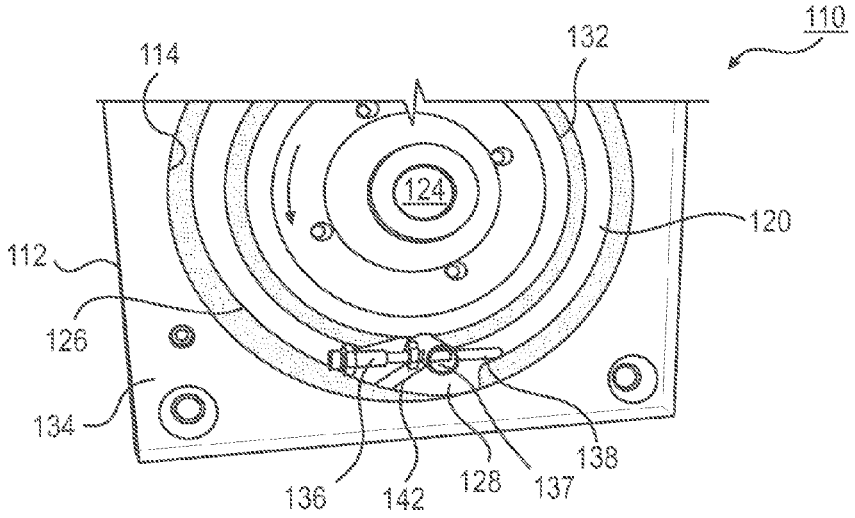
FIG. 1 is a front view of the present invention with the upper portion broken away.
Figure 2:
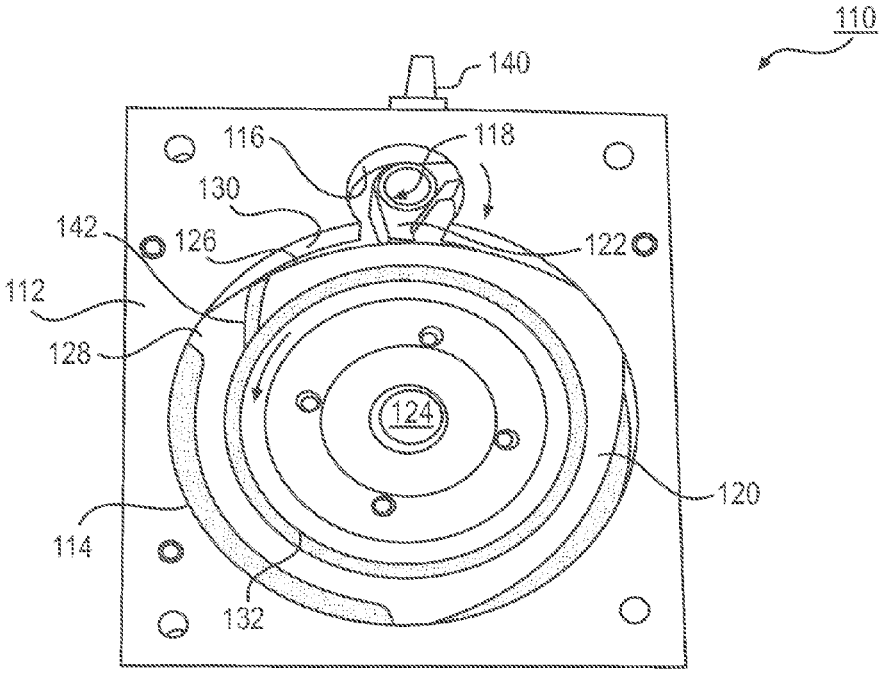
FIG. 2 is a front view of the present invention with the front plate removed therefrom, showing how the fuel air mixture can be compressed in the compression chamber.
Figure 3:
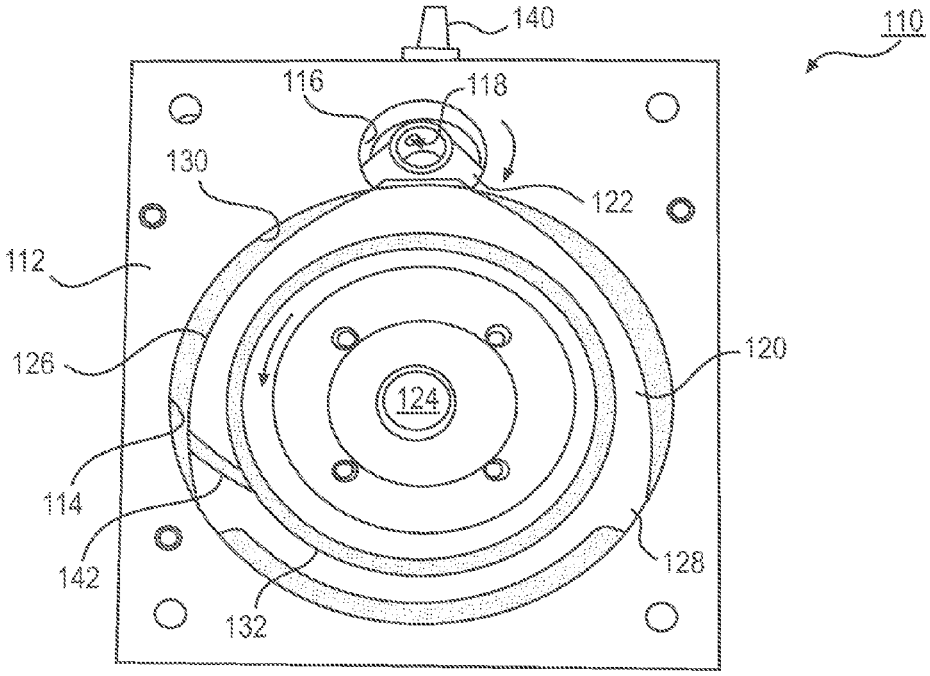
FIG. 3 is a front view similar to FIG. 2, showing how the fuel air mixture can be compressed to its maximum density in the compression chamber.
Figure 4:
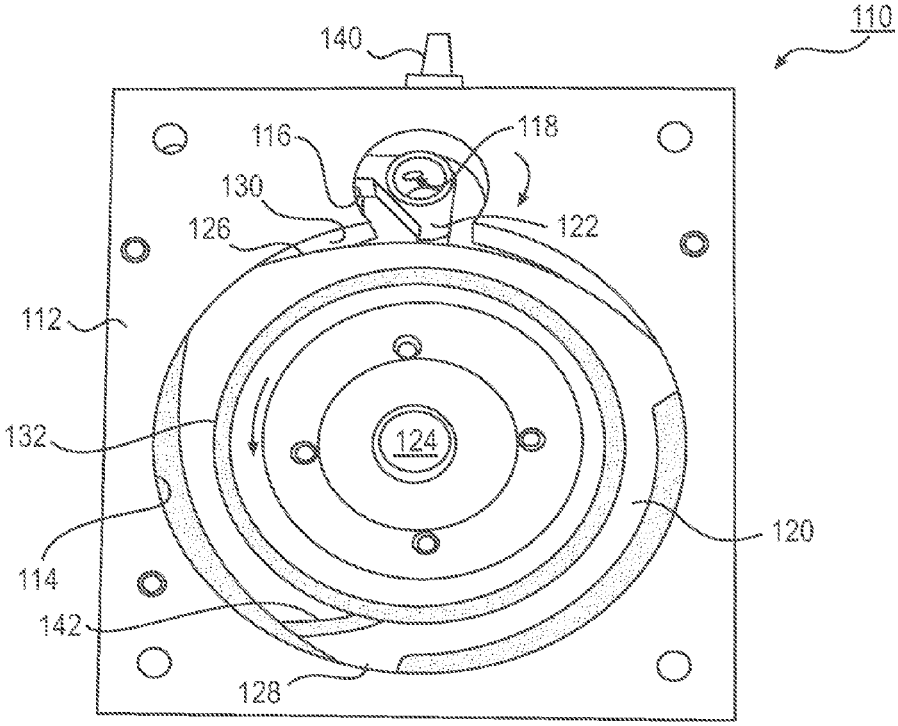
FIG. 4 is a front view similar to FIG. 3, showing how the piston rotor can be rotated counterclockwise by the rapidly expanding gases.

110 rotary engine
112 casing in rotary engine 110
114 large circular boring in casing 112
116 small circular boring in casing 112
118 exhaust port in power head 122
120 piston rotor in large circular boring 114
122 power head in small circular boring ported for exhaust flow
122.1 powerhead shaft
124 shaft in piston rotor 120
126 depression on circumference for intake and compression 128
128 on circumference of piston rotor 120
130 compression chamber between depression 126 and large circular boring 114
132 intake collector ring on piston rotor 120
134 front plate on casing 112
136 carburetor on front plate 134
137 fresh air intake on carburetor 136
138 fuel intake stem on carburetor 136
140 solid state ignition system on casing 112
140.1 plug/coil module
140.2 ignition reference sensor
140.3 battery/alternator
140.4 ignition switch
140.5 CDI module
142 Involute pumping gases from collector ring to intake/compression chamber 130
144 gear train
146 bevel gear mounted on main rotor shaft
148 bevel gear mounted on power head shaft
150 shaft with bevel gears on each end

DETAILED DESCRIPTION OF THE PREFERRED EMBODIMENT

The present invention, as shown in FIGS. 1, 2, 3, 4 and 5A is a rotary engine 110 which comprises a casing 112 having a large circular boring 114, a small circular boring 116, whereby the small circular boring 116 interconnects with the large circular boring 114. A piston rotor 120 is carried in a rotating manner within the large circular boring 114 in the casing 112. A power head 122 is carried in a rotating manner within the small circular boring 116 in the casing 112. The piston rotor and the powerhead maintain a precise rotational relationship 1:1 ratio with each other thru a gear train mounted externally to this chamber (not shown) . The piston rotor rotates counter clockwise while the powerhead rotates clockwise.

A shaft 124 extends centrally from the piston rotor 120 for power output therefrom. The piston rotor 120 has a depression 126 formed on its circumference 128 to produce a compression chamber 130 between the depression 126 and the large circular boring 114 in the casing 112. An involute 142 integrated on the piston rotor 120 can move collector ring gases into the compression chamber 130.

As shown in FIG. 1, a front plate 134 is mounted on the casing 112. A carburetor 136 having a fresh air intake 137 and a fuel intake 138 is affixed to the front plate 134 to supply a fuel air mixture into the collector ring 132. A solid state ignition system 140 on the casing 112 ignites the compressed fuel air mixture at the appropriate time in the cycle, at or near top dead center. Exhaust gases travel through the power head 122 and exit out of the exhaust port 118 in the power head 122. The casing 112 is fabricated of a suitable durable material, such as aluminum, steel or ceramic.

In review, the rotary engine 110 is a high efficiency, high torque, engine that is designed to be used for a wide variety of applications. The present invention comprises a casing 112 that is cast and/or machined of a suitable durable material, such as aluminum, steel, or ceramic. The casing 112 houses in a large circular boring 114 a piston rotor 120 and a power head 122. A shaft 124 runs through the center of the piston rotor 120 for power output and upon which additional power packs may be mounted as dictated by power and design requirements. The power head 122 with the exhaust port 118 affects the desired compression ratio and is installed in a small circular boring 116.

An involute 142 is cast into or otherwise integrated with the piston rotor 120 to help move the fuel air mixture from the collector ring 132 into the compression chamber 130 between a depression 126 on a circumference 128 of the piston rotor 120 and the large boring in the casing. A carburetor 136 having a fresh air intake 137 and a fuel intake 138 is mounted on a front plate 134 to provide a fuel air mixture.

A solid state ignition system 140 mounted on casing 112 ignites the fuel air mixture in the case of fuel requiring a spark. Compression ignition provides the igniting source for fuels of that type. The rotary engine can have the size of 8 inches (W), 10 inches (L) and 12 inches (H). The engine can rotate from 300 revolution per minutes (rpm) to 20,000 rpm. The volume's compression chamber can be 50 cc-5000 cc. The measurements and other specifications will vary widely depending on power and speed demands on the particular application.

Figure 5A:
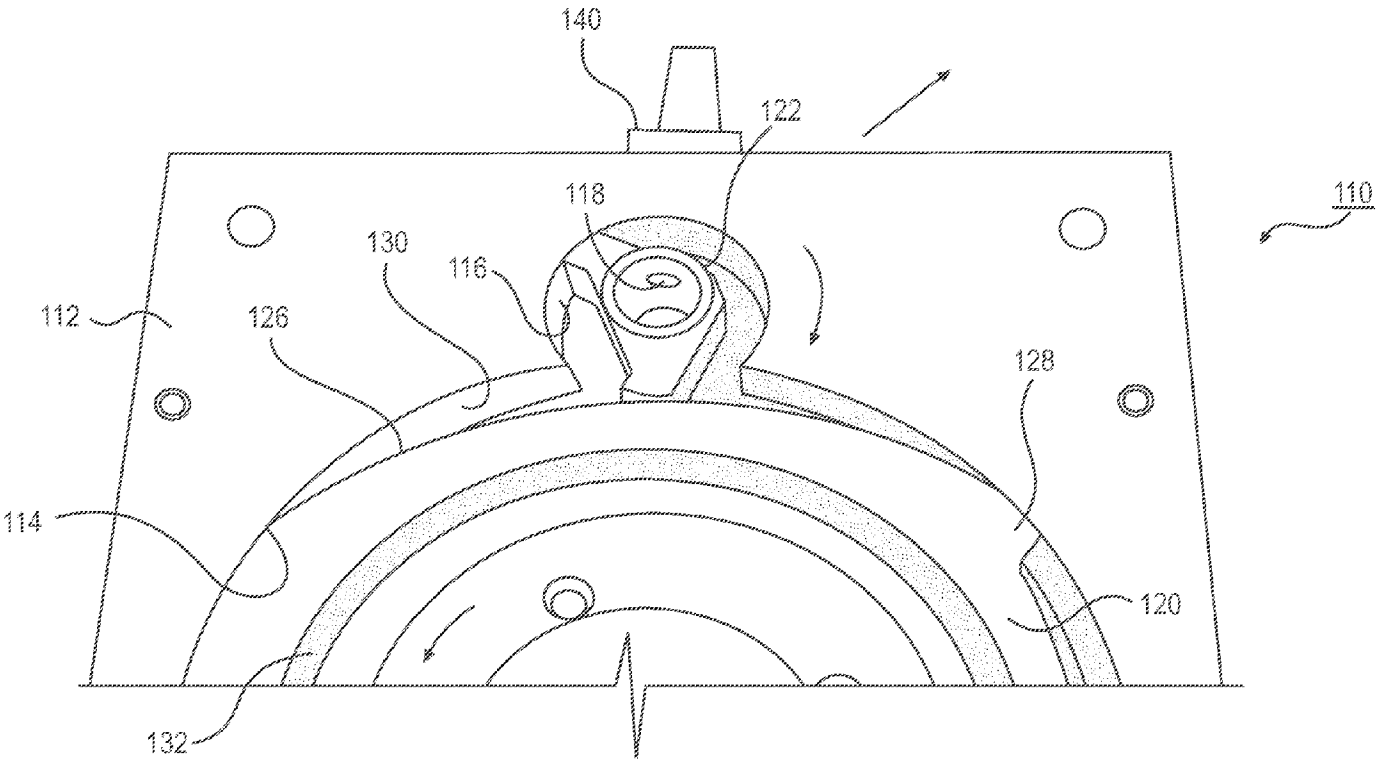
FIG. 5A is a front view similar to FIG. 4 with the lower portion broken away, showing how the exhaust gases can flow out through the hollow shaft in the power head.
Figure 5B:
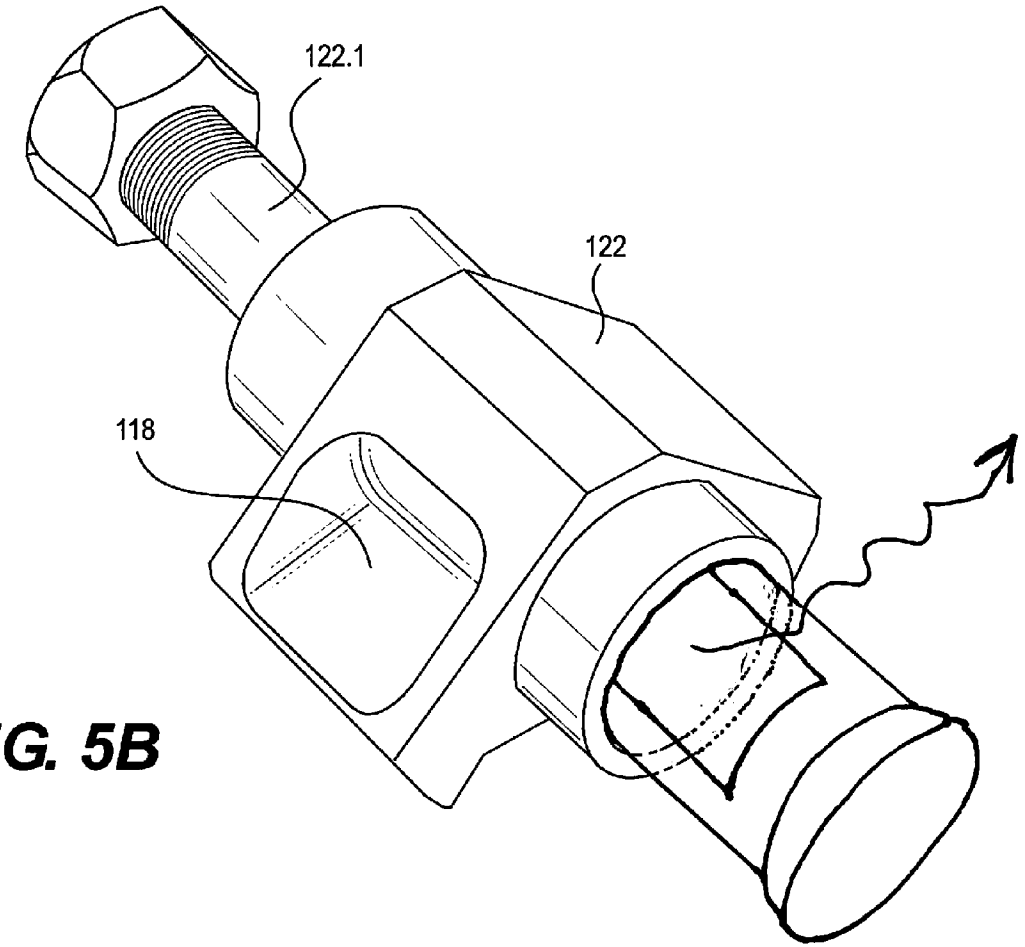
FIG. 5B is a perspective view similar of a power head, showing how the exhaust gases can flow out through the hollow shaft in the power head.

As shown in FIG. 5B, the power head 122 with the exhaust port 118 and a powerhead shaft 122.1.

Figure 6:
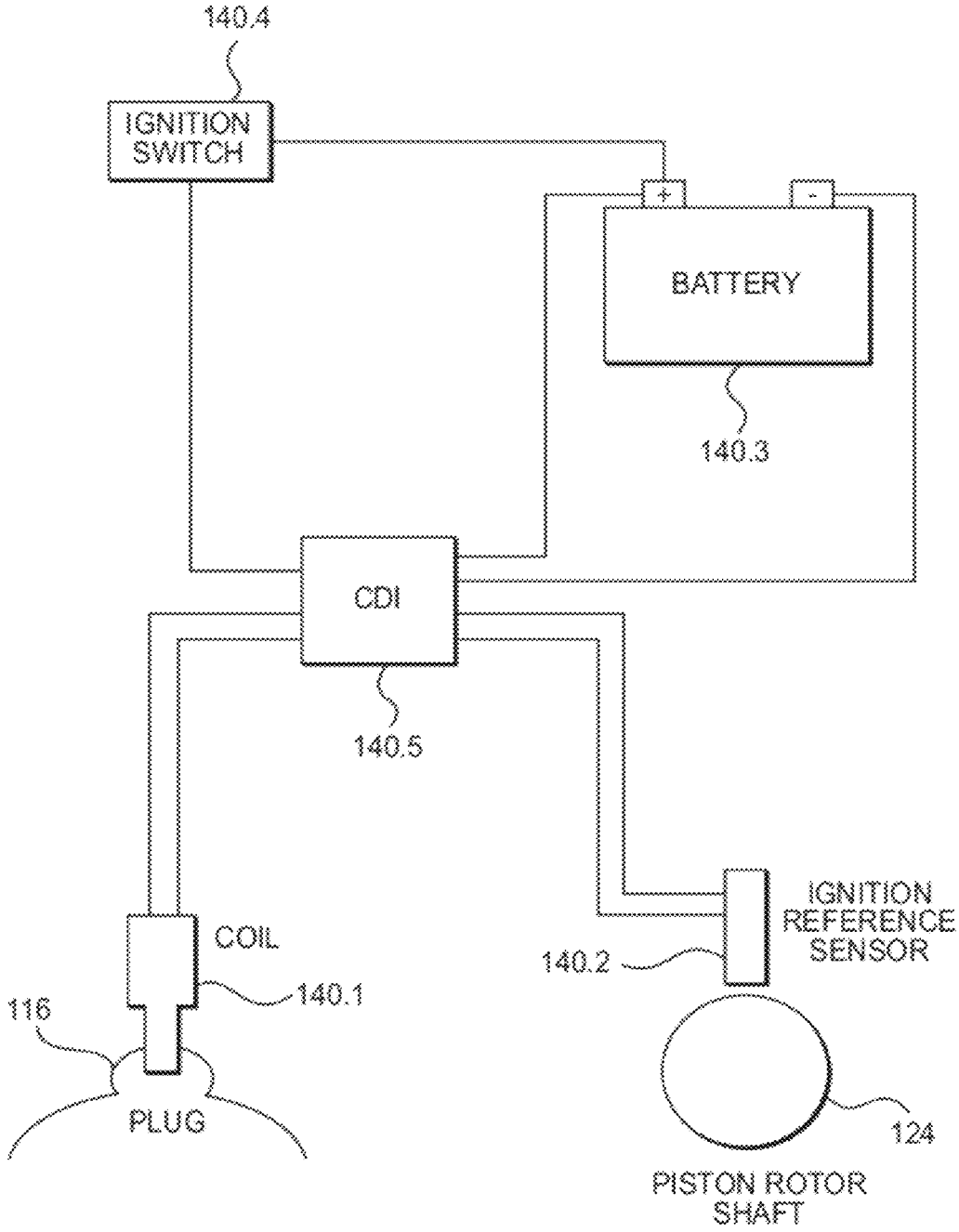
FIG. 6 is a circuit diagram of CDI ignition.

As shown in FIG. 6, spark ignition is effected thru the use of a capacitor discharge ignition (CDI) solid state ignition because it is currently considered more satisfactory for high rpm engines. It consists of plug/coil module 140.1 installed in the area directly under the powerhead, a CDI ignition module 140.5 to provide the necessary voltage 140, an ignition reference sensor 140.2 mounted on the piston rotor shaft 124 to provide timing of the spark, a battery/alternator 140.3 to provide initial voltage and an ignition switch 140.4 to turn the system on and off.

Figure 7A:
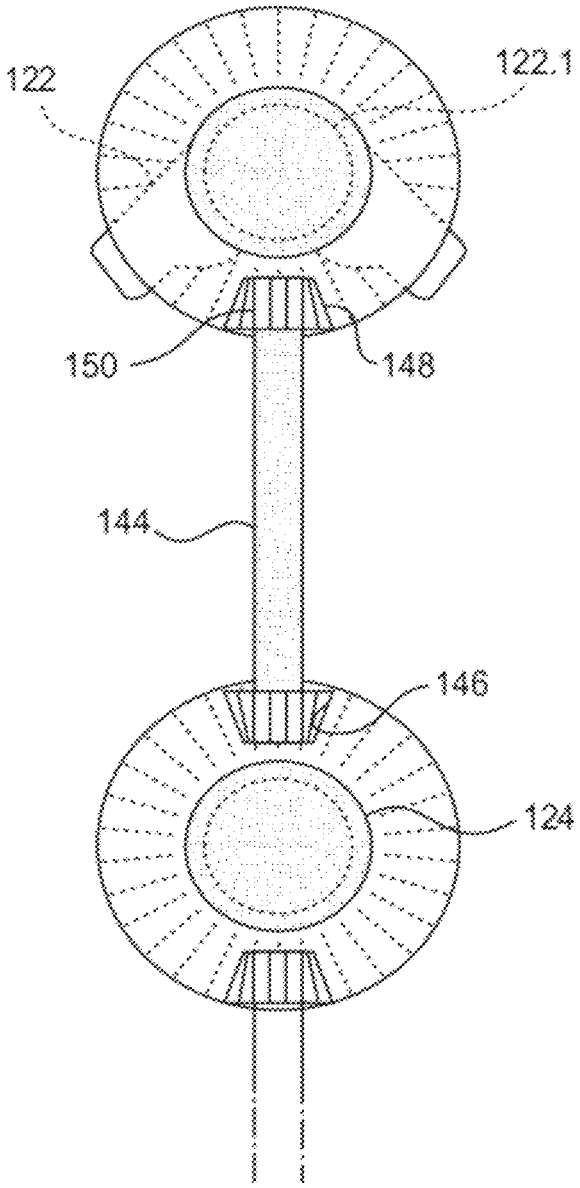
FIG. 7A is a backview of a gear train coupling to the power head and rotor shaft.

As shown in FIG. 7A, the gear train 144 consist of a bevel gear 146 mounted and keyed to the main rotor shaft 124, a similar bevel gear 148 mounted and keyed to the power head shaft, and a shaft with bevel gears 150 mounted on each end to mesh with the gears on the main rotor shaft 124 and the power head shaft 122.1. This gear train, properly mounted on the rear case on the rotary engine will cause the piston rotor and the powerhead to maintain the proper angular relationship 1:1 ratio. The piston rotor and the power head maintain a precise rotational relationship 1:1 ratio with each other thru a gear train mounted externally to this chamber (not shown) . The piston rotor rotates counter clockwise while the power head rotates clockwise.

Figure 7B:
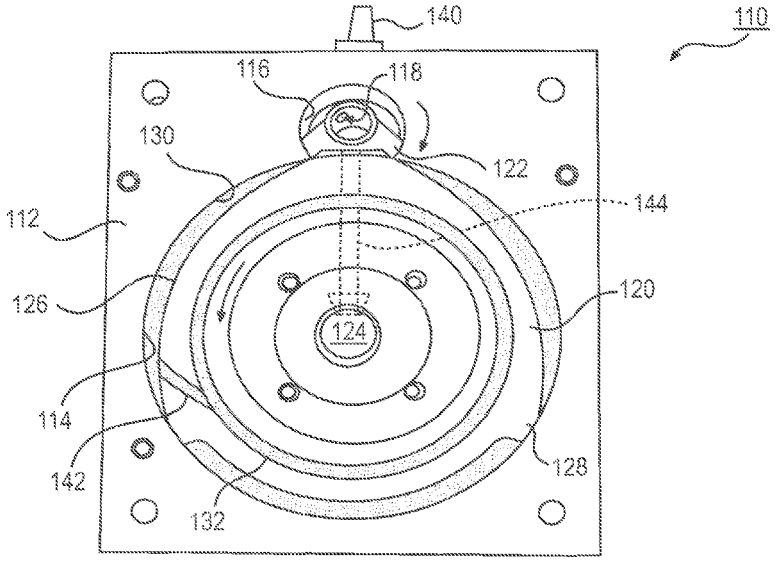
FIG. 7B is a front view similar to FIG. 3 with the phantom gear train on the back.

As shown in FIG. 7B, a gear train 144 (in phantom) mates the piston rotor shaft 124 and the power head 122, so that they are timed to maintain the proper angular relationship 1:1 ratio. The piston rotor 124 and the power head 122 maintain a precise rotational relationship 1:1 ratio with each other thru a gear train mounted externally to this chamber. The piston rotor 124 rotates counter clockwise while the power head rotates clockwise.

Figure 8:
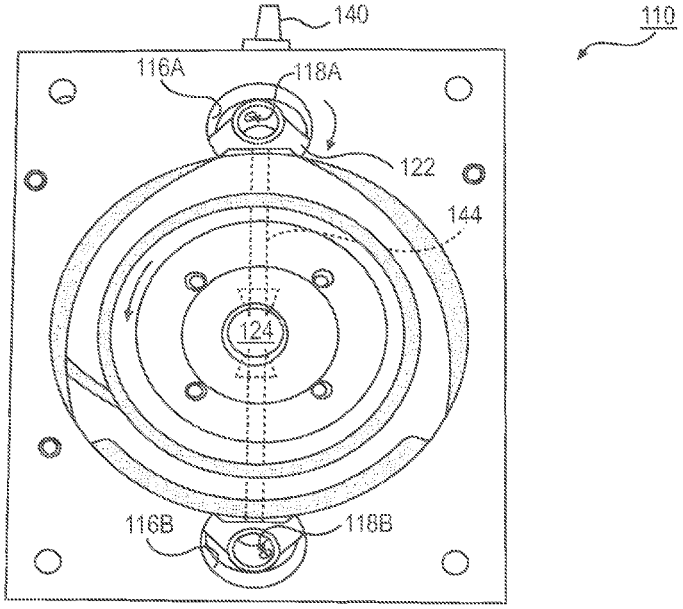
FIG. 8 is a front view similar to FIG. 3, showing how the engine has two symmetric power heads.
Figure 9:
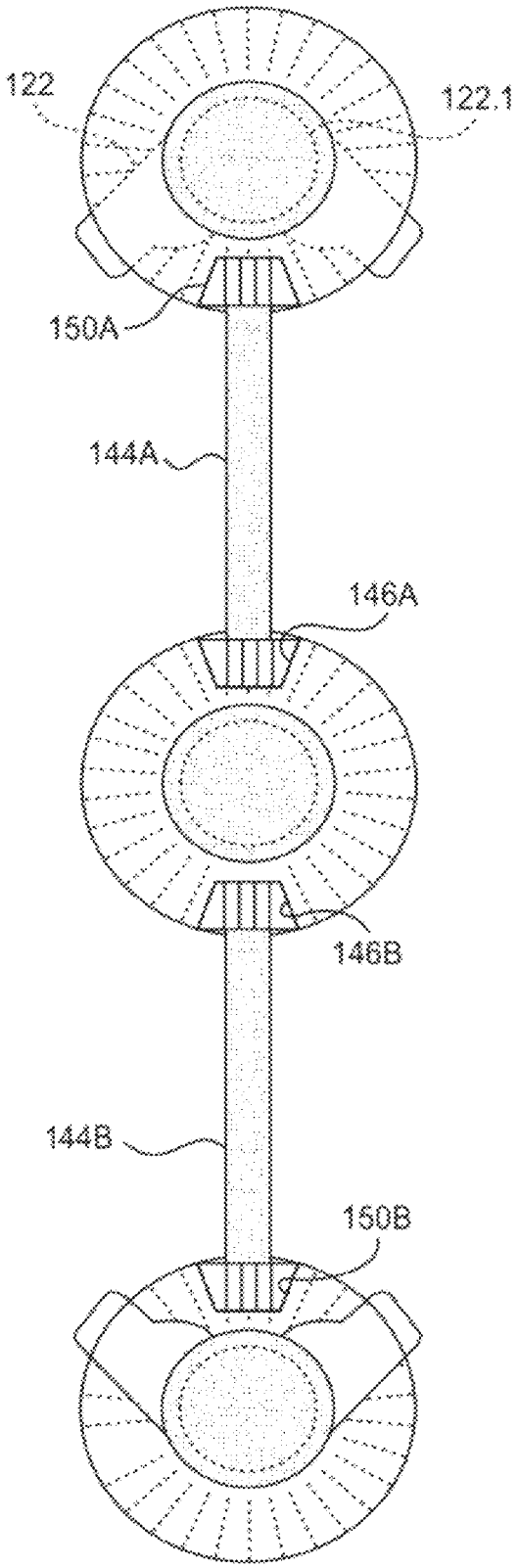
FIG. 9 is a backview of a gear train coupling to the first power head, a rotor shaft, and a second power head.

As shown in FIGS. 8-9: the rotary engine herein described can be fabricated with multiple power heads 122 (first head 116A/118A and second head 116B/118B) (via 2 gear coupling 146A, 146B aligned in a same axis) in the casing with a single piston rotor shaft 124. It can also be fabricated with multiple piston rotor/powerhead combinations on a common main shaft and powerhead shafts with a common gear train 144A-144B. The piston rotor and the first power head maintain a precise rotational relationship 1:1 ratio with each other thru a gear train mounted externally to this chamber (not shown). The piston rotor rotates counter clockwise while the two power heads rotates clockwise.

It will be understood that each of the elements described above, or two or more together, may also find a useful application in other types of constructions differing from the types described above.

While the invention has been illustrated and described as embodiments of a rotary engine, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A rotary engine comprising:

a) a casing having a large circular boring and a small circular boring, wherein the small circular boring interconnects with the large circular boring, wherein a front plate is mounted onto the casing and a rear plate is mounted onto the casing;

b) a piston rotor positioned within the large circular boring in the casing and configured to rotate within the large circular boring, the piston rotor having three depressions formed in a circumference of the piston rotor, the three depressions configured to provide, within the large circular boring:

an intake/compression chamber, a power/exhaust chamber adjacent to the intake/compression chamber, and a cooling chamber adjacent to the intake/compression chamber;

c) a power head positioned within the small circular boring in the casing and configured to rotate within the small circular boring, the power head including an exhaust port to vent exhaust gases into a ported hollow center shaft within the power head;

d) a rotor shaft extending centrally from the piston rotor for providing power output in combination with additional power output provided from a power head shaft extending from the power head;

e) a gear train mounted on the rear plate of the casing, the gear train comprising:

a first bevel gear mounted and affixed to the rotor shaft, a second bevel gear being identical to the first bevel gear, mounted and affixed to the power head shaft, and a linking shaft having first and second gears that are mounted on opposite ends of the linking shaft and that are positioned to respectively engage the first bevel gear on the rotor shaft and the second bevel gear the power head shaft;

f) a centrifugal pump involute and a collector ring integrated on the front side of the piston rotor for drawing/compressing a fuel/air mixture into the intake/compression chamber;

g) a carburetor affixed to the front plate, the carburetor having an air intake port and a fuel intake port to supply the fuel/air mixture to the collector ring; and h) a capacitor discharge solid state ignition system wired to a spark plug and mounted on the front plate, wherein the capacitor discharge solid state ignition system is timed to cause the spark plug to fire as the compressed fuel/air mixture approaches maximum compression under the power head and near top dead center;

wherein the piston rotor and the power head are configured to counter rotate at equal angular rotational speeds, wherein the gear train is configured to provide a 1:1 gear ratio for maintaining the equal angular rotational speeds;

wherein the piston rotor and the power head are configured to rotate in synchronization during operation, such that a gas-tight seal is formed during an intake/compression cycle and a power/exhaust cycle;

wherein the piston rotor and the power head are configured such that ignition of the fuel/air mixture causes the fuel/air mixture to expand between the piston rotor and the power head in the power/exhaust chamber and thereby produce power on the front side of the power head;

wherein a vent on the backside of the power head is configured to vent the exhaust gases resulting from a previous firing to the atmosphere.

2. The rotary engine as recited in claim 1, wherein the capacitor discharge solid state ignition system further includes:

a plug/coil module installed in an area directly under the power head; and a capacitor discharge ignition module to provide a voltage, an ignition reference sensor mounted on the rotor shaft to provide timing of the sparking of the spark plug, a battery/alternator to provide an initial voltage 12V and an ignition switch to turn the capacitor discharge solid state ignition system on and off.

3. The rotary engine as recited in claim 1, wherein the casing is made of a durable material.

4. The rotary engine as recited in claim 3, wherein the durable material is aluminum.

5. The rotary engine as recited in claim 3, wherein the durable material is steel.

6. The rotary engine as recited in claim 3, wherein the durable material is ceramic.

7. A rotary engine comprising:

a) a casing having a large circular boring and a first small circular boring and a second small circular boring which are diametrically opposed, wherein the small circular boring interconnects with the large circular boring wherein a front plate is mounted onto the casing and a rear plate is mounted onto the casing;

b) a piston rotor having three depressions formed in a circumference of the piston rotor, the three depressions configured to provide, within the large circular boring: an intake/compression chamber, a power/exhaust chamber adjacent to the intake/compression chamber, and a cooling chamber adjacent to the intake/compression chamber;

c) a first power head including a first exhaust port to vent exhaust gases into a first ported hollow center exhaust sleeve that is inside a first power head shaft and fixed to the front plate, wherein the first power head is mounted within the first small circular boring in the casing;

d) a second power head diametrically being opposed and identical to the first power head, the second power head including a second exhaust port to vent exhaust gases into a second ported hollow center exhaust sleeve that is inside a second power head shaft and fixed to the front plate, wherein the second power head is mounted within the second small circular boring in the casing;

e) a rotor shaft extending centrally through the piston rotor for power output, wherein the first power head shaft and the second power head shaft are configured to provide additional power;

f) a gear train mounted on the rear plate of the casing, the gear train comprising:

a first bevel gear mounted and affixed to the first power head shaft, a second bevel gear mounted and affixed to the second power head shaft, a third bevel gear mounted and affixed to the rotor shaft, a fourth bevel gear and a fifth bevel gear at opposite ends of a first linking shaft, the fourth bevel gear positioned to engage the first bevel gear mounted on the first power head, the fifth bevel gear positioned to engage the third bevel gear mounted on the rotor shaft, a sixth bevel gear and a seventh bevel gear at opposite ends of a second linking shaft, the sixth bevel gear positioned to engage the second bevel gear mounted on the second power head, the seventh bevel gear positioned to engage the third bevel gear mounted on the rotor shaft, g) a centrifugal pump involute and a collector ring integrated into the piston rotor for drawing/compressing a fuel/air mixture into the intake/compression chamber;

h) a carburetor having a fuel intake port and an air intake port affixed to the front plate to supply the fuel/air mixture into the collector ring;

i) a capacitor discharge solid state ignition system on the casing, the capacitor discharge solid state ignition system having a spark plug module that is located under at least one of the first power head and the second power head, wherein the spark plug module is configured to fire the fuel/air mixture into the intake/compression chamber at or near top dead center, wherein the first power head and the second power head are rotatable with respect to the piston rotor at a common angular rotational speed, wherein the gear train is configured to provide a 1:1 gear ratio for maintaining the common angular rotational speed;

wherein the piston rotor and the first power head and the second power head are configured to rotate in synchronization with the piston rotor such that a gas-tight seal is maintained during an intake/compression cycle and a power/exhaust cycle, wherein the piston rotor and the first power head and the second power head are intermeshed to rotate during operation, wherein when the piston rotor rotates counterclockwise, the first power head and the second power head rotate clockwise;

wherein the rotary engine is configured to cause the fuel/air mixture to move into the intake/compression chamber by a combination of centrifugal force and suction, and wherein the first exhaust port and the second exhaust port are configured to allow the exhaust gases to flow through the first power head and the second power head and out of the rotary engine via the first and second ported hollow center exhaust sleeves.

8. The rotary engine as recited in claim 7, wherein the rotary engine has a size of 8 inches (W), 10 inches (L) and 12 inches (H).

9. The rotary engine as recited in claim 7, wherein the rotary engine rotate from 300 revolution per minutes to 20,000 revolution per minutes as required by a load anticipated.

10. The rotary engine as recited in claim 7, wherein a volume's compression chamber is in a range of 50 cc-5000 cc.

11. The rotary engine as recited in claim 7, wherein the casing is made of aluminum.

12. The rotary engine as recited in claim 7, wherein the casing is made of a durable material.

13. The rotary engine as recited in claim 12, wherein the durable material is steel.

14. The rotary engine as recited in claim 12, wherein the durable material is ceramic.

* * * * *

UNITED STATES PATENT AND TRADEMARK OFFICE

CERTIFICATE OF CORRECTION

PATENT NO. : 8,967,114 B2
APPLICATION NO. : 13/417197
DATED : March 3, 2015
INVENTOR(S) : John Larry Gaither It is certified that error appears in the above-identified patent and that said Letters Patent is hereby corrected as shown below:

In the Specification

In column 3, lines 51-52, delete “to the power head and rotor shaft” and insert --the power head to the rotor shaft--.

In column 3, lines 57-58, delete “to the first power head, a rotor shaft, and a second power head” and insert --the first power head to the rotor shaft and the second power head to the rotor shaft--.

Signed and Sealed this
Ninth Day of June, 2015

Michelle K. Lee

Michelle K. Lee
*Director of the United States Patent and Trademark Office*